US008678302B2

(12) United States Patent
Ohlhafer et al.

(10) Patent No.: US 8,678,302 B2
(45) Date of Patent: Mar. 25, 2014

(54) INJECTION DEVICE

(75) Inventors: Olaf Ohlhafer, Bletighelm-Bissingen (DE); Robert Giezendanner-Thoben, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 747 days.

(21) Appl. No.: 12/578,888

(22) Filed: Oct. 14, 2009

(65) Prior Publication Data

US 2010/0187336 A1 Jul. 29, 2010

(30) Foreign Application Priority Data

Oct. 15, 2008 (DE) ..... 10 2008 042 850

(51) Int. Cl.
*B05B 1/30* (2006.01)

(52) U.S. Cl.
USPC ..... 239/585.1; 239/584; 239/533.1; 239/102.2; 251/57; 251/129.17

(58) Field of Classification Search
USPC ..... 239/88, 533.1, 585.2, 102.2, 584; 251/57, 129.17
See application file for complete search history.

(56) References Cited

U.S. PATENT DOCUMENTS

| | | | | |
|---|---|---|---|---|
| 5,169,067 | A | 12/1992 | Matsusaka et al. | |
| 5,875,764 | A * | 3/1999 | Kappel et al. | 123/467 |
| 6,570,474 | B2 * | 5/2003 | Czimmek | 335/215 |
| 6,752,333 | B2 * | 6/2004 | Hohl | 239/585.1 |
| 6,883,725 | B2 * | 4/2005 | Hohl et al. | 239/102.2 |

FOREIGN PATENT DOCUMENTS

| | | |
|---|---|---|
| DE | 102006026153 | 12/2007 |
| JP | S58-96164 | 6/1983 |
| JP | 58-155232 | 9/1983 |
| JP | S58-155232 | 9/1983 |
| JP | 60-60254 | 4/1985 |
| JP | H04-16628 | 3/1992 |
| JP | H04-86367 | 3/1992 |
| JP | H10-184498 | 7/1998 |

* cited by examiner

*Primary Examiner* — Dinh Q Nguyen
(74) *Attorney, Agent, or Firm* — Kenyon & Kenyon LLP

(57) ABSTRACT

An injection device for injecting a medium, including a valve arrangement with a valve member forming a seal at a valve seat, wherein the valve arrangement is arranged in the medium to be injected, an actuator device with an actuator, a plunger and a return element, and a pulse-transmitting device which is arranged between the valve arrangement and the actuator device, which separates the valve arrangement from the actuator device in a fluid-tight manner and which transmits a pulse generated by the actuator device to the medium to be injected in order in that manner to open the valve arrangement and inject medium.

12 Claims, 2 Drawing Sheets

INJECTION DEVICE

RELATED APPLICATION INFORMATION

The present application claims priority to and the benefit of German patent application no. 10 2008 042 850.7, which was filed in Germany on Oct. 15, 2008, the disclosure of which is incorporated herein by reference.

FIELD OF THE INVENTION

The present invention relates to an injection device having a valve arrangement, an actuator device, and a pulse-transmitting device which separates the valve arrangement from the actuator device in a fluid-tight manner and which transmits a pulse generated by the actuator device to the medium to be injected. The present invention further relates to a method for injecting a medium by an injection device, wherein a pulse generated by the actuator device is transmitted via the pulse-transmitting device to the medium and then to the valve arrangement.

BACKGROUND INFORMATION

There are injection devices from the related art in various embodiments. What is particularly important in this area is the production by the injection device of an optimum fuel-air mixture, usually referred to as a spray, for combustion in the combustion chamber. Such injection devices are, however, very complex and, in particular, expensive since to prepare the spray either high system pressures are generated in order to convert hydraulic pressure energy into kinetic energy or, in alternative methods, spray production is accomplished using high-frequency shock waves.

German patent document DE 10 2006 026 153 A1, for example, discusses spray production using high-frequency shock waves generated by piezo actuators. In that case, the actuator is situated in the medium to be injected. The shock-wave-exciting element is also situated in the medium to be injected in the case where shock waves are generated by a defined spark discharge. In that case, some of the medium to be injected is subjected in addition to extremely high temperatures. The contact of the actuators used to generate the shock waves with the medium that is to be injected may lead to interactions between the medium and the actuators, which may result in chemical or physical damage both to the medium to be injected and to the actuators. Furthermore, the quality of the spray is unsatisfactory as regards droplet size distribution and velocity of the spray front both in the case of actuators for spark discharge and in the case of piezo actuators.

For that reason, the solutions mentioned have only inadequate suitability for use in, for example, modern diesel engines.

SUMMARY OF THE INVENTION

The injection device according to the present invention having the features described herein has, by contrast, the advantage that it both has a simpler geometry and configuration, and accordingly is easy and inexpensive to manufacture, and produces a more homogeneous and improved spray. In accordance with the exemplary embodiments and/or exemplary methods of the present invention, that is achieved by virtue of the fact that the injection device has a pulse-transmitting device which is arranged between the valve arrangement and the actuator device and which separates the valve arrangement, which is in contact with the medium, from the actuator device in a fluid-tight manner. The simple construction of the actuator device, which is not arranged in the medium, prevents potential interactions between medium and actuator and enables optimized pulse transmission to be achieved by the pulse-transmitting device, which results in a more homogeneous injection spray and consequently in improved combustion with lower fuel consumption and reduced emissions.

The subordinate claims indicate exemplary developments of the present invention.

Especially, the actuator device may further include a transmission chamber which is arranged between the plunger and the pulse-transmitting device. It is thereby possible to achieve especially simple, inexpensive and functionally reliable pulse transmission to the pulse-transmitting device.

In accordance with a further embodiment of the present invention, the transmission chamber holds a vacuum or is filled with fluid. In that manner, as low-loss as possible and as rapid as possible movement and pulse transmission from the plunger to the actuator device is achieved.

The injection device may include a valve arrangement with a valve member forming a seal at a valve seat and with a bearing element, and also an actuator device with an actuator, a plunger and a return element. The pulse-transmitting device transmits a pulse generated by the actuator device to the medium to be injected. The fluid-tight arrangement of the actuator device with respect to the valve arrangement arranged in the medium to be injected ensures interaction-free and operationally reliable generation of the pulse required for the injection operation.

Especially, the valve member may be configured to be reversibly deformable and is deformed by the generated pulse and lifted from the valve seat in order for medium to be injected. By virtue of the configuration chosen, it is possible to minimize the number of components and achieve a further cost saving. Furthermore, it is possible to dispense with a separate return element for the valve member.

The valve member may include a plurality of deformable arms, whereby even and durably consistent functioning of the valve member is ensured. The arms are able to undertake a reproducible reversible deformation of the valve member.

Especially, the valve member may be supported on the bearing element by the arms. This has the advantage that a multi-point and more even support on the bearing element is achieved.

In accordance with a further exemplary embodiment, the valve member includes exactly four arms which are arranged at angles of 90°. Accordingly, the valve opening may be adjusted by way of the four contact points between the valve member and the bearing element in a symmetrical and axially precise manner. Furthermore, uniform deformation of the arms may be achieved.

The valve member may be a valve member that opens outward. This has the advantage that by virtue of that configuration an improved opening, closing and sealing behavior may be achieved.

Especially, the valve member may include a conical surface. That geometrical configuration is especially advantageous for the impinging pulse wave in order for an improved spray to be developed.

In accordance with a further exemplary embodiment, the pulse-transmitting device includes a diaphragm or a transmission plunger. The diaphragm has, in particular, the advantage that an inexpensive, operationally reliable and durable seal may be produced between the valve arrangement and the actuator device. The diaphragm may be made of Kevlar.

Especially, the actuator may be formed by an electromagnet which is considerably simpler and cheaper than the piezo elements used in the related art.

The present invention further relates to a method for injecting a medium by an injection device including a valve arrangement which is arranged in the medium to be injected, an actuator device, and a pulse-transmitting device which is arranged between the valve arrangement and the actuator device. A pulse generated by the actuator device is transmitted via the pulse-transmitting device to the medium and then to the valve arrangement in order to make an injection of medium. That method is simple and inexpensive to carry out and makes a very simple layout of the injection device possible. In addition to making pulse transmission possible, the pulse-transmitting device at the same time enables actuator device and valve arrangement to be separated in a fluid-tight manner.

An exemplary embodiment of the present invention is described below with reference to the accompanying drawings.

DETAILED DESCRIPTION

An injection device 1 of the present invention in accordance with a first exemplary embodiment is described in detail below with reference to FIGS. 1 to 3.

Figure 1:
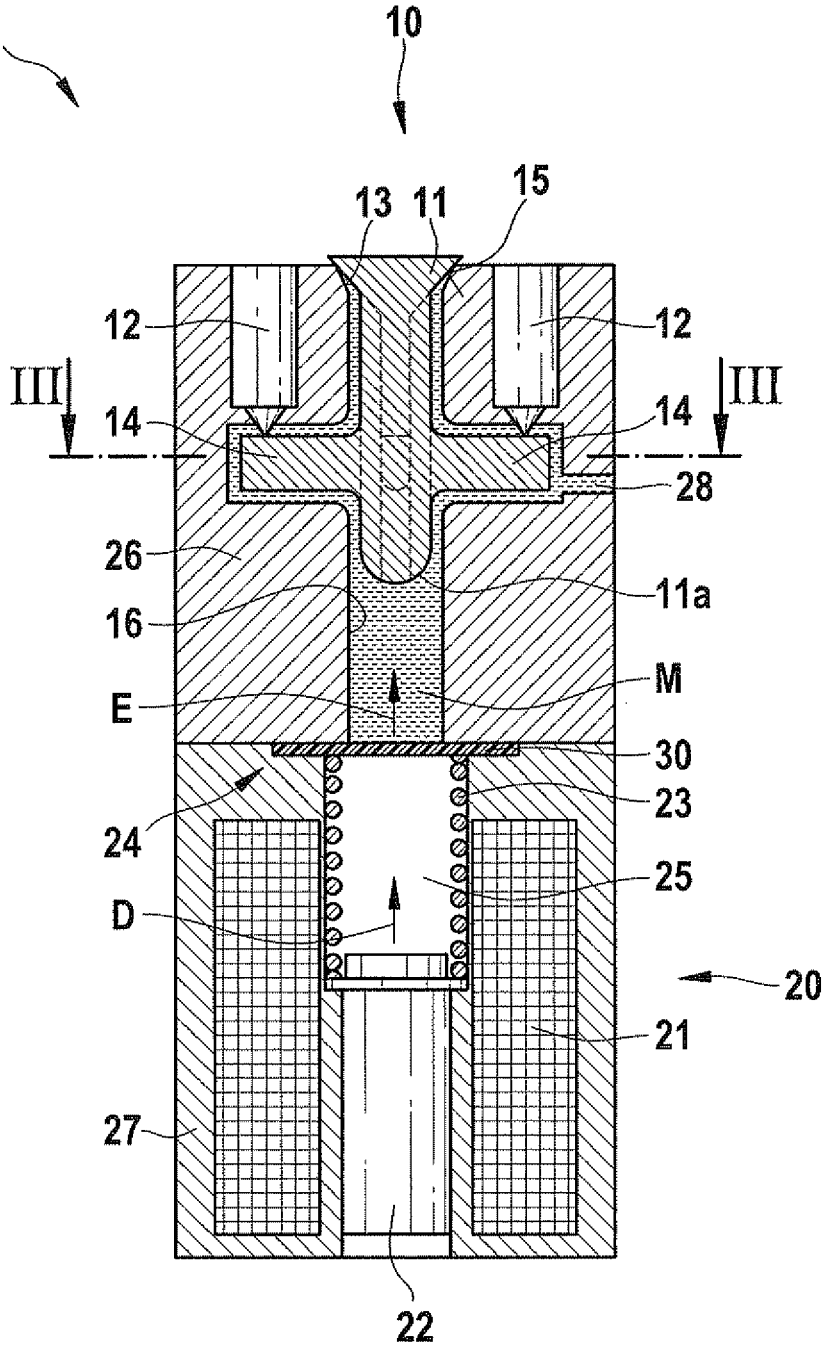
FIG. 1 shows a schematic sectional illustration of the layout of the injection device according to the present invention in the closed state.

FIG. 1 is a schematic sectional illustration of injection device 1 in the closed state, including in a first housing part 26 a valve arrangement 10 with a sealing valve member 11 and a bearing device 12 with four bearing elements. As may be seen from FIG. 1, valve arrangement 10 is arranged in a metering chamber 16 in medium M to be injected which is supplied through a feed duct 28.

Valve member 11 is arranged on a valve seat 13 and has a conical surface 15. The valve member further includes a rounded rear end 11*a* and a plurality of arms 14 of which only two are visible in this sectional illustration.

Figure 3:
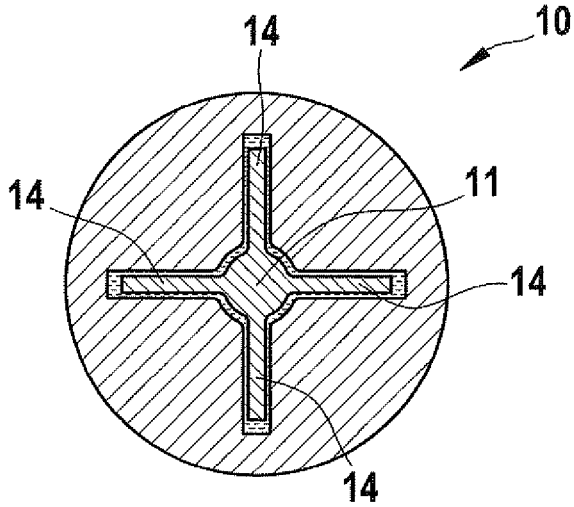
FIG. 3 shows a sectional illustration of the valve element along the line III-III of FIG. 1.

As may be seen from FIG. 3, which is a sectional illustration of valve arrangement 10 along the line III-III of FIG. 1, in this exemplary embodiment valve member 11 may have four arms 14 arranged circumferentially at angles of 90°.

Bearing device 12 supports valve member 11 at arms 14 and is configured to be adjustable. The adjustability of each of the bearing elements of bearing device 12 makes it possible to vary the pre-loading applied to arms 14 in the closed state of valve member 11. This may even lead to bending of resilient arms 14.

Injection device 1 further includes, in a second housing part 27, an actuator device 20 with an actuator 21, a plunger 22, a return element 23 and a transmission chamber 25. On operation or activation of actuator 21, which is an electromagnetic coil, plunger 22, which is an armature made of a magnetic or magnetizable material, is moved as a result of interaction with actuator 21 in the direction of an arrow D. Return element 23 returns plunger 22 to its starting position when actuator 21 is not activated.

Arranged between valve arrangement 10 and actuator device 20 there is a pulse-transmitting device 24 which separates valve arrangement 10 from actuator device 20 in a fluid-tight manner by a diaphragm 30 and which transmits a pulse generated by actuator device 20 to medium M to be injected in order in that manner to open valve arrangement 10 and inject medium M.

Transmission chamber 25, which is arranged between plunger 22 and pulse-transmitting device 24, is filled with a liquid or a gas under high pressure. Alternatively, a vacuum may be used instead. By energization of actuator 21, plunger 22 is displaced in the direction of arrow D into transmission chamber 25 and produces a pulse which is transmitted to diaphragm 30 in the direction of an arrow E. Diaphragm 30 arches and transmits the pulse to medium M to be injected. The pulse of membrane 30 induces a shock wave in medium M to be injected.

Figure 2:
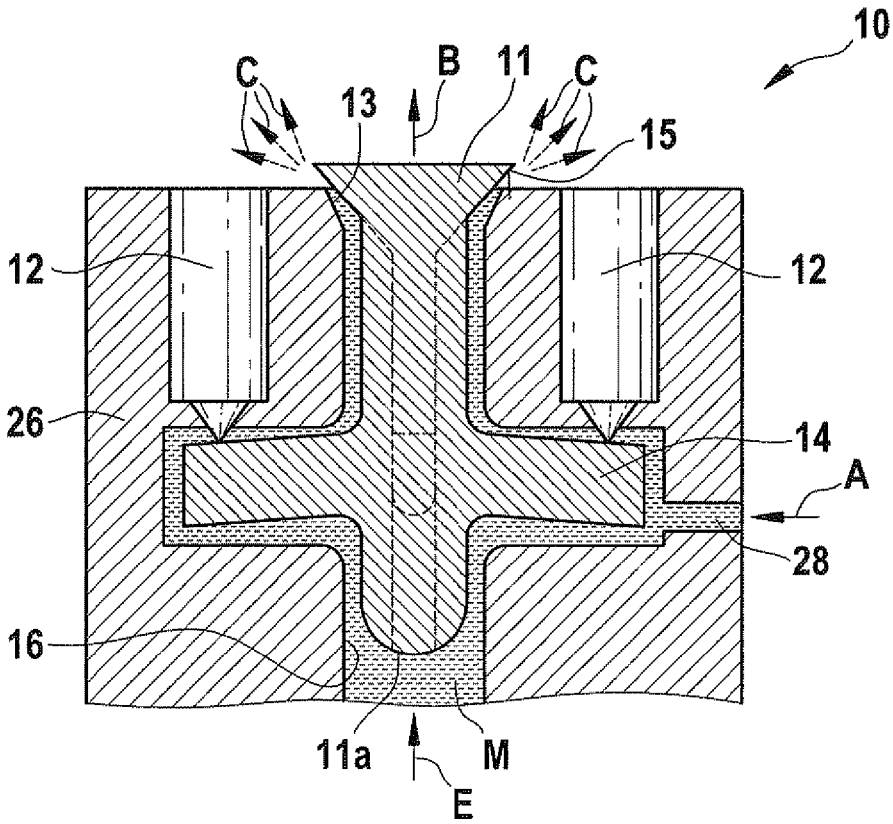
FIG. 2 shows a schematic sectional illustration of the layout of the injection device according to the present invention in the open state.

FIG. 2 is a schematic illustration of valve arrangement 10, housed in first housing part 26, of injection device 1 in the open state in which a shock wave induced by transmitting device 24 in the direction of arrow E acts on valve member 11. Owing to the effect of the pulse, valve member 11 is displaced in the direction of an arrow B, with arms 14 which are supported by bearing device 12 being resiliently deformed, in order to lift conical surface 15 from valve seat 13 and cause medium M to exit through valve member 11, which is opening outward, in the direction of arrows C. To make it possible to achieve as homogeneous as possible a pulse action on valve member 11, the surfaces of valve member 11 facing toward the shock wave impinging thereon, namely rear end 11*a* of valve member 11 and the undersides of arms 14, may be rounded or conically tapered. In that manner, as low-loss as possible a flow of medium M entering through feed duct 28 may be achieved. In addition, valve member 11 is of a symmetrical construction. When an injection operation ends, filling of metering chamber 16 takes place again via feed duct 28.

The injection device of the present invention in accordance with the exemplary embodiment operates as follows. The coil of actuator 21 is activated for an injection operation and displaces or accelerates plunger 22 at high speed in the direction of arrow D into transmission chamber 25. Transmission chamber 25 makes low-loss and rapid displacement of plunger 22 possible. During displacement, plunger 22 reaches a speed in excess of 100 m/s. Plunger 22 is able to deform the diaphragm or the displacement of plunger 22 causes the medium in transmission chamber 25 to transmit a pulse to diaphragm 30 of pulse-transmitting device 24 which separates valve arrangement 10 and actuator device 20 in a fluid-tight manner.

Owing to the generated pulse, diaphragm 30, which may be made of Kevlar, deforms or rather arches abruptly in the direction of an arrow E and transmits a shock wave to medium M which is situated only in valve arrangement 10. The shock wave propagating through medium M impinges at supersonic speed on the surfaces facing toward the direction of the pulse, namely rear end 11*a*, the undersides of arms 14 and conical surface 15 of valve member 11 and, owing to the effect of the force which then results, opens valve member 11 outward. In that process, the four resilient arms 14 of the valve member are reversibly deformed. The order of magnitude of the opening force may be determined from the effective surface area of conical surface 15 (in the plane of the shock wave) and the maximum pressure of the shock wave. In the injection operation, an annular gap opens between conical surface 15 of valve element 11 and valve seat 13, which gap promotes improved or optimized spray production. After the shock wave has lifted valve member 11, the region of negative pressure following the overpressure and behind the shock wave provides for rapid closing of valve member 11, with arms 14 of valve member 11, which are supported by bearing element 12, also being unloaded again and being resiliently deformed in reverse. For the next injection pulse, diaphragm 30 re-assumes its original shape owing to its material properties and plunger 22 is returned by return element 23 to its starting position when energization of the coil has ceased. The quantity of medium M injected is then replaced via feed duct 28.

Owing to the assemblies (valve arrangement and actuator device) which are separated from each other by pulse-transmitting device 24 with diaphragm 30, injection device 1 according to the exemplary embodiments and/or exemplary methods of the present invention has a very simple geometry and configuration, allowing inexpensive manufacture. Owing to actuator device 20 which is sealed from the medium to be injected, interactions between actuator device 20 and the medium to be injected, which may occur in devices of the related art, are avoided. By virtue of that construction, injection device 1 according to the present invention is able to use a controllable electromagnet and an accelerated armature (plunger 22) in actuator device 20 and is able to accelerate plunger 22 in transmission chamber 25 to the high terminal velocity in excess of 100 m/s in order to induce a sufficient pulse onto diaphragm 30.

Furthermore, in the case of valve arrangement 10 of the injection device according to the present invention, an exact and expensive seal between valve seat 13 and conical surface 15 of valve member 11 is not necessary. Resiliently deformable arms 14 serve as defined spring elements, and therefore valve arrangement 10 is able to dispense with additional return elements. For metering of the injection quantity, bearing element 12 is infinitely variable. Two different strategies may be used here. In the passive strategy, bearing element 14 is set to a constant closing force, but on prolonged operation plastic deformation of arms 14 and a reduction of the closing force may occur. In the active strategy, bearing element 12 may be individually actuated on each injection, for example by piezo elements. In that manner it is possible to regulate or compensate for long-time effects, for example, and to adjust the quantity injected by regulating the closing force. That strategy may be applied separately from and in combination with the energization time or energization level of actuator 21 of actuator device 20. In that manner it is possible to achieve regulation of the quantity injected and of the duration of injection and optimization of the spray characteristics, resulting in reduced exhaust gas emissions and lower fuel consumption.

What is claimed is:

1. An injection device for injecting a medium, comprising:

a valve arrangement having a valve member forming a seal at a valve seat, wherein the valve arrangement is arranged in the medium to be injected;

an actuator device having an actuator, a plunger and a return element; and a pulse-transmitting device arranged between the valve arrangement and the actuator device, the pulse-transmitting device not directly contacting the valve arrangement or the actuator device, separating the valve arrangement from the actuator device in a fluid-tight manner and transmitting a pulse generated by the actuator device to the medium to be injected in that manner to open the valve arrangement and inject medium;

wherein the actuator device further includes a transmission chamber which is arranged between the plunger and the pulse-transmitting device;

wherein the valve member includes a plurality of deformable arms.

2. The injection device of claim 1, wherein the transmission chamber holds a vacuum or is filled with fluid.

3. The injection device of claim 1, wherein the valve arrangement includes a bearing device, wherein the bearing device is arranged in the medium to be injected, and wherein the bearing device supports the valve member.

4. The injection device of claim 3, wherein bearing elements on the bearing device are configured to be adjustable.

5. The injection device of claim 1, wherein the valve member is reversibly deformable and is deformed by the generated pulse in order to be lifted from the valve seat and inject the medium.

6. The injection device of claim 1, wherein the valve member is a valve member that opens outward.

7. The injection device of claim 1, wherein the valve member includes a conical surface.

8. The injection device of claim 1, wherein the pulse transmitting device includes one of a diaphragm, which is made of Kevlar, and a transmission plunger.

9. The injection device of claim 1, wherein the actuator is an electromagnet.

10. An injection device for injecting a medium, comprising:

a valve arrangement having a valve member forming a seal at a valve seat, wherein the valve arrangement is arranged in the medium to be injected;

an actuator device having an actuator, a plunger and a return element; and a pulse-transmitting device arranged between the valve arrangement and the actuator device, which separates the valve arrangement from the actuator device in a fluid-tight manner and which transmits a pulse generated by the actuator device to the medium to be injected in that manner to open the valve arrangement and inject medium;

wherein the valve member is reversibly deformable and is deformed by the generated pulse in order to be lifted from the valve seat and inject the medium;

wherein the valve member includes a plurality of deformable arms.

11. The injection device of claim 10, wherein the valve member is supported by the arms on bearing elements on the bearing device.

12. The injection device of claim 10, wherein the valve member includes exactly four arms which are arranged at angles of 90°.

* * * * *